US008679719B2

(12) United States Patent
Yamaguchi et al.

(10) Patent No.: US 8,679,719 B2
(45) Date of Patent: Mar. 25, 2014

(54) CARRIER, DEVELOPER AND ELECTROPHOTOGRAPHIC DEVELOPING METHOD AND IMAGE FORMING METHOD

(75) Inventors: Kimitoshi Yamaguchi, Numazu (JP); Naoki Imahashi, Mishima (JP); Kousuke Suzuki, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 1042 days.

(21) Appl. No.: 12/048,997

(22) Filed: Mar. 14, 2008

(65) Prior Publication Data

US 2008/0227004 A1 Sep. 18, 2008

(30) Foreign Application Priority Data

Mar. 16, 2007 (JP) ..... 2007-068336
Apr. 10, 2007 (JP) ..... 2007-102672
Jan. 24, 2008 (JP) ..... 2008-013730

(51) Int. Cl.
*G03G 9/00* (2006.01)
*G03G 13/08* (2006.01)

(52) U.S. Cl.
USPC ..... 430/111.35; 430/111.1; 430/111.3; 430/111.34; 430/111.41; 430/118.8; 430/123.58

(58) Field of Classification Search
USPC ..... 430/48, 111.3, 11.34, 111.41, 111.1, 430/111.34, 111.35, 118.8, 123.58
See application file for complete search history.

(56) References Cited

U.S. PATENT DOCUMENTS 6,472,118 B1 10/2002 Yamaguchi et al.
6,599,672 B2 7/2003 Yamaguchi et al.
6,696,213 B2 2/2004 Yamaguchi et al.
6,735,409 B2 5/2004 Takahashi et al.
6,739,534 B2 5/2004 Yamaguchi et al.
6,743,558 B2 6/2004 Yamaguchi et al.
6,939,654 B2 9/2005 Kotsugai et al.
7,192,679 B2 3/2007 Yamaguchi et al.
7,320,852 B2 1/2008 Kotsugai et al.
2003/0044709 A1 3/2003 Yamaguchi et al.
2003/0211415 A1* 11/2003 Yamaguchi et al. ..... 430/111.35
2005/0158643 A1 7/2005 Yamaguchi et al.
2006/0057487 A1 3/2006 Nagayama et al.
2006/0063093 A1* 3/2006 Kurosu ..... 430/122
2006/0127793 A1 6/2006 Hotta et al.
2006/0210905 A1 9/2006 Imahashi et al.

(Continued)

FOREIGN PATENT DOCUMENTS

JP 58-144839 8/1983
JP 8-314202 * 11/1996

(Continued)

OTHER PUBLICATIONS

Office Action issued Mar. 15, 2012 in Japanese Application No. 2008-013730.

*Primary Examiner* — Thorl Chea
(74) *Attorney, Agent, or Firm* — Oblon, Spivak, McClelland, Maier & Neustadt, L.L.P.

(57) ABSTRACT

An object of the present invention is to provide a carrier containing core material particles having magnetism and a coating layer on the surfaces of the core material particles, wherein the core material particles have a magnetization at a magnetic field of 1,000 Oersted of 40 emu/g to 100 emu/g, and the carrier has a weight average particle diameter of 20 μm to 45 μm, a resistance (Log R) of 11 Ω·cm to 17 Ω·cm and a relaxation time τ of 150 seconds to 800 seconds.

10 Claims, 3 Drawing Sheets

(56) References Cited

U.S. PATENT DOCUMENTS

| | | | | |
|---|---|---|---|---|
| 2007/0048652 | A1* | 3/2007 | Imahashi et al. | 430/111.33 |
| 2007/0243482 | A1 | 10/2007 | Yamaguchi et al. | |
| 2009/0080848 | A1 | 3/2009 | Suzuki et al. | |

FOREIGN PATENT DOCUMENTS

| | | | |
|---|---|---|---|
| JP | 10-288869 | | 10/1998 |
| JP | 11-38752 | | 2/1999 |
| JP | 3029180 | | 2/2000 |
| JP | 2001-209215 | | 8/2001 |
| JP | 2002-251038 | | 9/2002 |
| JP | 2003-241410 | | 8/2003 |
| JP | 2005-250424 | | 9/2005 |
| JP | 3726592 | | 10/2005 |
| JP | 2006-154806 | | 6/2006 |
| JP | 2009-75362 | A5 | 4/2009 |

* cited by examiner

CARRIER, DEVELOPER AND ELECTROPHOTOGRAPHIC DEVELOPING METHOD AND IMAGE FORMING METHOD

BACKGROUND OF THE INVENTION

1. Field of the Invention

The present invention relates to a carrier containing core material particles having magnetism and a coating layer on the surfaces of the core material particles, and also relates to a developer containing the carrier, an electrophotographic developing method and an image forming method using the developer.

2. Description of the Related Art

A developing process of electrophotography is classified into a one-component developing process using a one-component developer containing a toner, and a two-component developing process using a two-component developer containing glass beads, a magnetic carrier, or a coated carrier in which the surface of the glass beads or magnetic carrier are coated with a resin, and a toner.

The charge characteristics is more stable in the two-component developing process than in the one-component developing process, because the carrier has a larger frictionally charged area. Thus, the two-component developing process is advantageous in maintaining high-quality image over a long-period of time and has a high-ability of supplying a toner to developed areas. Thus, the two-component developing process is frequently used particularly in high-speed machines.

In an electrophotographic system employing a digital method in which a latent electrostatic image is formed on a photoconductor using a laser beam or the like, and the latent electrostatic image is formed into a visible image, the two-component developing method utilizing the above noted characteristics is also widely employed.

In recent years, to respond to increases in resolution, enhancements in high-light reproducibility of image, improvements in image granularity (roughness), and colorization, the minimum unit (one dot) of latent electrostatic image has been minimized, and image density growth has been improved. Especially, developments of image developing systems capable of developing these latent electrostatic images (dots) with fidelity have become extremely important, and there have been various proposals from both sides of developing process conditions and a developer (toner and carrier).

From the viewpoint of developing process, making developing gap closely contacted, making a thin layer for a photoconductor, and making smaller diameter of a writing beam diameter, etc. are effective, however, these solutions still leave problems in terms of high-cost and reliability.

From the viewpoint of a developer, making a smaller particle diameter of toner and making a smaller particle diameter of carrier have been studied, and there have been various proposals on use of a carrier having a small particle diameter.

For example, Japanese Patent Application Laid-Open (JP-A) No. 58-144839 proposes a magnetic carrier containing ferrite particles having a spinel structure and an average particle diameter of 30 μm or less, however, the proposed carrier is not coated with a resin and is used under low-electric field, and is disadvantages in that it is poor developing ability, and the operating life is short.

Japanese Patent (JP-B) No. 3029180 proposes an electrophotographic carrier containing carrier particles having an average particle diameter ($D_{50}$) of 15 μm to 45 μm at a ratio of 50%, in which the carrier particles having a particle diameter of less than 22 μm at a ratio of 1% to 20%, carrier particles having a particle diameter of less than 16 μm at a ratio of 3% or less, carrier particles having a particle diameter of 62 μm or more at a ratio of 2% to 15%, and carrier particles having a particle diameter of 88 μm or more at a ratio of 2% or less, and the specific surface area $S_1$ of the carrier determined by air permeability method and the specific surface area $S_2$ of the carrier calculated by the following equation: $S_2=(6/\rho \cdot D_{50})\times 10^4$ ($\rho$ represents a specific gravity of carrier) satisfy the formula $1.2 \leq S_1/S_2 \leq 2.0$.

When any of these above-noted carriers having smaller particle diameters is used, there are the following advantages:

(1) it is possible to give a sufficient frictional charge to individual toner particles because the carrier has a large surface area per unit volume, and the low-charge toner and oppositely-charged toner less occur. As a result, background smear hardly occurs, there is fewer amounts of toner dust and image blur in the areas around dots, and the use of the carrier makes it possible to obtain excellent dot reproducibility.

(2) it is possible to make the average charge amount of toner lowered because the carrier has a large surface area per unit volume and rarely cause background smear, and sufficient image densities can be obtained. Thus, the carrier having small particle diameters enables reducing troubles at the time of using a toner having small particle diameters, and is effective particularly in deriving advantages of use of a toner having small particle diameters.

(3) a carrier having a small particle diameter is capable of forming dense magnetic brush. Since the magnetic brush has excellent flowability, magnetic brush trails are hardly left on image surfaces.

However, the each of the proposed carriers having smaller particle diameters as described in JP-B No. 3029180 has disadvantages in that carrier adhesion easily occurs, and it is difficult to put them into practical use because the carrier adhesion causes occurrences of photoconductor flaws and fixing roller flaws.

In particular, when a carrier having a weight average particle diameter of less than 45 μm is used, the carrier surface smoothness is drastically improved, and a high quality image can be obtained, however, there are problems that carrier adhesion occurs very easily, and a high-quality image cannot be maintained over a long period of time.

JP-A No. 11-38752 discloses the description regarding a time constant. However, the time constant is measured under a contact state, and electric resistance R in the time constant is correlated to a static resistance Log R which is measured using a conventional cell. Thus, JP-A No. 11-38752 discloses an invention relating to a time constant of a developer containing a carrier and a toner, not to a time constant of a carrier.

Recently, there is a trend that the carrier diameter is made smaller for high image quality and high reliability. Because the surface area per unit weight is large (large specific surface area) in the carrier particles having small diameters, the carrier particles having small diameters do not easily release charge, compared to carrier particles having large diameters. Particularly, carrier adhesion caused by counter-charge, i.e. reverse-charge has been a big problem for the carrier having a small diameter.

The force Fc of causing carrier adhesion is associated with developing potential, background potential, centrifugal force applied on carrier, carrier resistance, and charge amount of a developer.

Thus, to prevent occurrences of carrier adhesion, it is effective to set various parameters such that the force Fc of causing carrier adhesion can be reduced. However, as it stands, it is difficult to drastically change the parameters because the force closely relates to developing ability, background smear, toner scattering, and the like.

BRIEF SUMMARY OF THE INVENTION

An object of the present invention is to provide a carrier which generates less initial carrier adhesion and carrier adhesion with time, particularly can prevent initial carrier adhesion caused by counter-charge and can form an image having high image density and excellent granularity (roughness), and a developer using the carrier, an electrophotographic developing method using the developer and an image forming method using the electrophotographic developing method.

To solve the above-described problems, the inventors of the present invention have focused on mainly changing the electric carrier resistance "R" in the following equation representing the relaxation time of carrier: $(\tau)=R\times C$, wherein "R" is an electric resistance of carrier, "C" is a capacity of carrier, and found that the relaxation time of carrier can be controlled by changing the electric resistance of carrier "R" by means of a method completely different from conventional ones.

Specifically, the inventors of the present invention have found that the carriers of the present invention, in which a coating layer is formed on a core material surface, have different relaxation times, even though the carriers have the same physical properties such as carrier resistance, and that the carrier adhesion can be significantly prevented by controlling the relaxation time. Specifically, in the carrier of the present invention, an electric resistance property which changes over time according to the charge amount remaining in the carrier, namely, the relaxation time is optimized, in addition to the static electric resistance.

The inventors of the present invention have found that the carrier used in a developing system, in which direct current bias is applied as a developing bias, is significantly effective to prevent carrier adhesion and background smear, and to improve image density.

The present invention has been accomplished based on the foregoing findings of the present inventors. The means to overcome the foregoing problems are as follows:

<1> A carrier containing core material particles having magnetism and a coating layer on the surfaces of the core material particles, wherein the core material particles have a magnetization at a magnetic field of 1,000 Oersted of 40 emu/g to 100 emu/g, and the carrier has a weight average particle diameter of 20 μm to 45 μm, a resistance (Log R) of 11 Ω·cm to 17 Ω·cm and a relaxation time τ of 150 seconds to 800 seconds.

<2> The carrier according to <1>, wherein the carrier has a weight average particle diameter Dw of 22 μm to 32 μm, and a ratio (Dw/Dp) of the weight average particle diameter Dw to a number average particle diameter of the carrier Dp satisfies $1<(Dw/Dp)<1.20$, the amount of the particles having a particle diameter of less than 20 μm is 0% by weight to 7% by weight, the amount of the particles having a particle diameter of less than 36 μm is 80% by weight to 100% by weight, and the amount of the particles having a particle diameter of less than 44 μm is 90% by weight to 100% by weight.

<3> The carrier according to <1>, wherein the core material particles contain Mn—Mg—Sr ferrite.

<4> The carrier according to <1>, wherein the core material particles contain Mn ferrite.

<5> The carrier according to <1>, wherein the core material particles contain magnetite.

<6> The carrier according to <1>, wherein the bulk density of the core material particles is 2.15 g/cm$^3$ to 2.70 g/cm$^3$.

<7> A developer containing a toner and a carrier, wherein the carrier contains core material particles having magnetism and a coating layer on the surfaces of the core material particles, wherein the core material particles have a magnetization at a magnetic field of 1,000 Oersted of 40 emu/g to 100 emu/g, and the carrier has a weight average particle diameter of 20 μm to 45 μm, a resistance (Log R) of 11 Ω·cm to 17 Ω·cm and a relaxation time τ of 150 seconds to 800 seconds.

<8> The developer according to <7>, wherein the toner has a charge amount of 15 μc/g to 30 μc/g when the toner coverage on the carrier is 50%.

<9> An electrophotographic developing method including supplying a toner from a developer containing a carrier and the toner to a surface of a photoconductor on which a latent electrostatic image is formed and developing the latent electrostatic image using the toner so as to form a visible image, wherein a direct current voltage as a developing bias is applied when the toner is supplied from the developer to the photoconductor, and wherein the carrier contains core material particles having magnetism and a coating layer on the surfaces of the core material particles, wherein the core material particles have a magnetization at a magnetic field of 1,000 Oersted of 40 emu/g to 100 emu/g, and the carrier has a weight average particle diameter of 20 μm to 45 μm, a resistance (Log R) of 11 Ω·cm to 17 Ω·cm and a relaxation time τ of 150 seconds to 800 seconds.

<10> The electrophotographic developing method according to <9>, wherein the carrier has a weight average particle diameter Dw of 22 μm to 32 μm, and a ratio (Dw/Dp) of the weight average particle diameter Dw to a number average particle diameter of the carrier Dp satisfies $1<(Dw/Dp)<1.20$, the amount of the particles having a particle diameter of less than 20 μm is 0% by weight to 7% by weight, the amount of the particles having a particle diameter of less than 36 μm is 80% by weight to 100% by weight, and the amount of the particles having a particle diameter of less than 44 μm is 90% by weight to 100% by weight.

<11> The electrophotographic developing method according to <9>, wherein the core material particles contain Mn—Mg—Sr ferrite.

<12> The electrophotographic developing method according to <9>, wherein the core material particles contain Mn ferrite.

<13> The electrophotographic developing method according to <9>, wherein the core material particles contain magnetite.

<14> The electrophotographic developing method according to <9>, wherein the bulk density of the core material particles is 2.15 g/cm$^3$ to 2.70 g/cm$^3$.

<15> The electrophotographic developing method according to <9>, wherein the toner which is supplied to the photoconductor is coated on the surface of the carrier, and the toner has a charge amount of 15 μc/g to 30 μc/g when the toner coverage on the carrier is 50%.

<16> An image forming method includes charging a surface of a photoconductor, exposing the charged surface of the photoconductor so as to form a latent electrostatic image, supplying a toner from a developer containing a carrier and the toner to the surface of the photoconductor on which the latent electrostatic image is formed, developing the latent electrostatic image using the toner so as to form a visible image, transferring the visible image to a recording medium and fixing the transferred image on the recording medium, wherein a direct current voltage as a developing bias is applied when the toner is supplied from the developer to the photoconductor, and wherein the carrier contains core material particles having magnetism and a coating layer on the surfaces of the core material particles, wherein the core material particles have a magnetization at a magnetic field of 1,000

Oersted of 40 emu/g to 100 emu/g, and the carrier has a weight average particle diameter of 20 μm to 45 μm, a resistance (Log R) of 11 Ω·cm to 17 Ω·cm and a relaxation time τ of 150 seconds to 800 seconds.

DETAILED DESCRIPTION OF THE INVENTION

Figure 1:
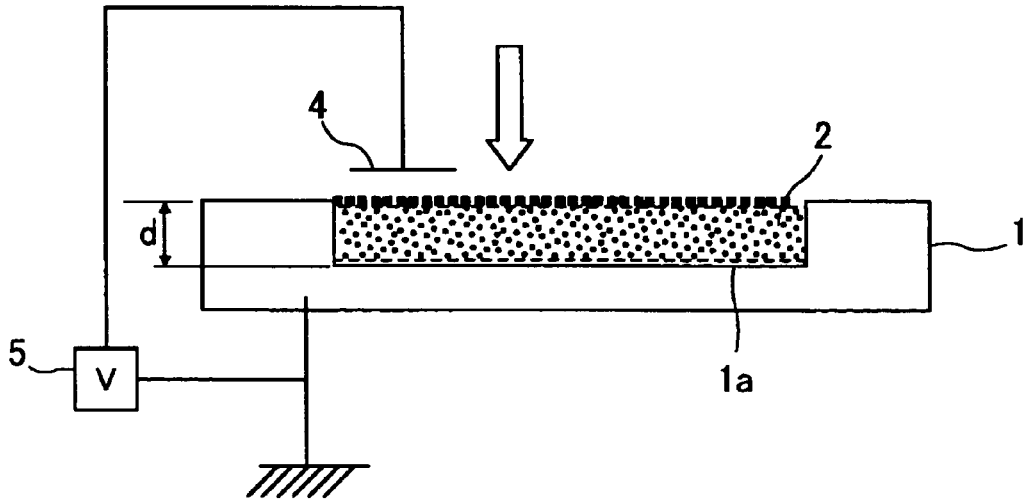
FIG. 1 is a schematic view of a measurement device for measuring a relaxation time of a carrier.

The carrier of the present invention contains core material particles having magnetism and a coating layer on the surfaces of the core material particles.

In the present invention, the core material particles have a magnetization at a magnetic field of 1,000 Oersted of 40 emu/g to 100 emu/g, and the carrier has a weight average particle diameter of 20 μm to 45 μm, a resistance (Log R) of 11 Ω·cm to 17 Ω·cm and a relaxation time τ of 150 seconds to 800 seconds. The carrier more preferably has a resistance (Log R) of 11.5 Ω·cm to 16.5 Ω·cm and a relaxation time of 200 seconds to 700 seconds.

In the present invention, the adhesion of a magnetic carrier has been examined. The magnetic carrier adhesion occurs in a form of carrier particles or cut-off magnetic brush when electric force causing a carrier adhering to a photoconductor becomes larger than the force of binding a carrier to a magnetic brush (a magnetic binding force—centrifugal force). Specifically, in the case where Fc represents a force of causing carrier adhesion, Fm represents a magnetic binding force, and they satisfy the condition of Fc>Fm in each particle, the carrier adhesion occurs. Note that Fc (a force of causing carrier adhesion) is a function associated with (a centrifugal force, resistance of resin coated carrier, electric field strength and charge amount), and the magnetic binding force Fm is represented by the equation, Fm=magnetization of carrier× magnetic tilt. In this case, the magnetization amount of a carrier particle is represented by the following equation:

$$\text{magnetization amount of a carrier particle}=\text{mass (g)}\times\text{magnetization (emu/g)}=(4/3\cdot\pi\cdot r^3)\cdot\rho\times M$$

wherein "ρ" represents a true specific gravity of the carrier particle, "r" represents a radius of the carrier particle, and "M" represents a magnetization amount of the carrier particles per unit mass.

As is clear from the above-described equation, a carrier particle has a magnetization amount proportional to the cube of the radius of the carrier particle "$r^3$". Thus, the magnetic binding force "Fm" is rapidly decreased, as the carrier particle becomes smaller. Therefore, the carrier adhesion is effectively prevented by increasing the magnetization amount of a particle, and making the centrifugal force smaller to increase a magnetic binding force. The core material is made to have larger particle diameter and a composition capable of obtaining a large magnetization amount so as to effectively increase the average magnetization amount of the core material particles. Moreover, it is important to reduce variations of magnetization between particles.

The carrier adhesion is classified into two types, an induced charge type and counter-charge type according to their mechanism.

The induced charge type carrier adhesion is caused by generating induced charge in a carrier by an electric field of an image part or non-image part (background part), because the carrier has a low resistance. Moreover, when a developing electric field is strong, an induced charge amount is increased, and carrier adhesion easily occurs.

Here, induced charge means a charge that is directly injected into the carrier particles through a developing sleeve and then remains in the carrier particles. Such induced charges participate more directly to carrier adhesion than charges generated by polarization inside the carrier material, which is induced according to the strength of external electric fields. Therefore, the toner having high resistance serves as a spacer, and charge injection to a carrier is hard to occur. However, when an electric field of a developing area is strong, toner particles on carrier move to a direction of an image bearing member or a developing sleeve in accordance with an electric field strength, and the toner amount on the carrier decreases. Thus, the carrier surface is exposed and the charge is easily injected along the carrier particles having low resistance. When the charge is injected into the carrier, the carrier adheres to the photoconductor by the electric field in the developing area, namely, so-called induced charge type carrier adhesion occurs.

Meanwhile, the carrier adhesion caused by counter-charge (hereinafter referred to as counter-charge type carrier adhesion) occurs by accumulation of charges with an opposite sign to a toner in a carrier by means of frictional charge. That is, the counter-charge type carrier adhesion occurs in such a manner that a charge having opposite polarity to that of a toner (counter-charge) is accumulated (generated) in a carrier by developing the toner, or a toner drifts from a carrier (the charged toner gradually separates from the carrier). Therefore, when the toner is borne on a latent electrostatic image bearing member, the charge having opposite polarity to that of the toner is accumulated in the carrier. Moreover, in a non-image area of the latent electrostatic image bearing member, the toner on the carrier moves away from the latent electrostatic image bearing member to a developing sleeve, a developer bearing member, and then the charge opposite to the toner remains in the carrier. This is also the counter-charge. The latter counter-charge occurs in a fraction of time (very short time) after the former counter-charge. At any rate, the occurrence of counter-charge is influenced by the speed at which the developing sleeve comes close to and moves away from a surface of the latent electrostatic image bearing member (for example, the rotational speed of the latent electrostatic image bearing member). Therefore, the carrier having high resistance is hard to relax the counter-charge. The large charge amount of developer increases amount of charge accumulation. Thus, a carrier charged opposite to a toner is called counter-charge.

Moreover, strong electric field of an image part or non-image part (background part) adversely affects the counter-charge type carrier adhesion as well as the induced charge type carrier adhesion.

Therefore, in both the induced charge type carrier adhesion and counter-charge type carrier adhesion, the electric field is necessarily controlled not to be too strong.

Recently, there is a trend that a carrier has a smaller diameter for high image quality and high reliability. Use of the carrier having small diameter causes a soft magnetic brush, thus, a developing gap, or a gap between a photoconductor and a developing sleeve can be narrowed. While high developing ability can be obtained by narrowing the developing gap, the electric field in a background part is stood out, and problems become obvious, for example, background smear and carrier adhesion easily occur. Because the surface area per unit weight is large in the carrier having small diameters, the charge carrier having a small diameter is hard to release charge, compared to a carrier having a large diameter. Particularly, the counter-charge type carrier adhesion becomes a serious problem.

The force Fc of causing carrier adhesion is associated with developing potential, background potential, centrifugal force applied on carrier, carrier resistance, and charge amount of developer, as described above. Thus, to prevent occurrences of carrier adhesion, it is effective to set various parameters such that the force Fc of causing carrier adhesion can be reduced. However, as it stands, it is difficult to drastically change the parameters because the force closely relates to developing ability, background smear, toner scattering, and the like.

The inventors of the present invention have been studied various factors to prevent the counter-charge type carrier adhesion, and found that it is effective to decrease the carrier relaxation time, so as to achieve the present invention.

It is important to avoid generation or accumulate of counter-charges so as to prevent the counter-charge type carrier adhesion. The following (i) to (iv) can be considered to prevent the counter-charge type carrier adhesion.

(i) To impart conductivity to a carrier by the following methods: decreasing the resistance of a coating layer to be applied on the carrier; making the coating layer thinner; using a resistance adjusting agent to the coating layer; using a filler having low resistance; decreasing the electric resistance of core material particles; and so forth.

(ii) To directly decrease the amount of counter-charge by decreasing the charge amount of a toner.

(iii) To easily release counter-charge, not only decrease the carrier resistance, but also activate a developer so as to increase the number of contacting the developer with a developing sleeve.

(iv) To prevent a toner movement to a developing sleeve in a non-image part, the speed of a developing sleeve relative to a photoconductor is reduced and electric field strength in a developing area is decreased.

From the relation as described in (i), R and capacity C of carrier relate to the conductivity of the carrier. Thus, a relaxation time ($\tau$), to which the electric resistance R and the capacity C are related, is focused on.

In the present invention, carrier relaxation time ($\tau$) is expressed by the equation: $\tau=R\times C$, where C represents capacity of carrier, which is mostly determined by materials of a core material and a coating layer, and their volume. On the other hand, an electric resistance R is found by a measured relaxation time and capacity. It has been revealed that the electric resistance R is materially different from a normal static electric resistance value, which is obtained by a known method, in which carrier is loaded in a cell, and then electric voltage is applied to the gap so as to measure current. This may be because the movement of a very small amount of charge generated by frictional charge is not always the same as that of an electric resistance value obtained by measuring current. Therefore, the counter-charge type carrier adhesion, which cannot be controlled by the electric resistance value obtained by using a conventional cell, becomes possible by controlling a relaxation time by means of a non-contact method of measuring relaxation time described later.

The carrier of the present invention has achieved to optimize an electric resistance property which changes in accordance with change with time of the charge amount remaining in a carrier, that is, relaxation time, in addition to the static electric resistance measured by using the cell.

Conventionally, an intended level of the static electric resistance of carrier can be obtained depending on kinds of core material particles of the carrier, resistance of the coating layer of the carrier and by using a resistance controlling agent to the coating layer. A proper relaxation time of the carrier of the present invention can be obtained by controlling a condition of forming the coating layer deposited on the carrier surface (by applying a coating solution to form a minimum part in which the coating layer is not formed, an invisible crack part, a part of irregular bonding, a minimum area in which the coating layer is ultrathin), or by applying mechanical energy to the carrier without toner so as to activate carrier surface, when the carrier is produced. Moreover, specifically, the proper relaxation time of the carrier of the present invention can be obtained by controlling the amount of exposed portions on the surface of the core material in the coated carrier, e.g. the unevenness of the thickness of the coating layer due to pinholes rather than the exposed core material caused by uneven coating. The proper relaxation time can be also obtained by controlling the condition of forming the coating layer by means of controlling aging by mechanical hazard, activation, scraping, filler, a core material shape, a coating condition and a mist diameter.

That is, the carrier of the present invention is optimized in terms of static resistance and a property of change with time of the charge amount remaining in the carrier, or relaxation time. This can be typically achieved by the uneven coating layer, which coats the core material of the carrier. The coating layer of the present invention has any small area being modified, and is hard to identify a non-modified part using a microscope or by visual observation, because the modified part may be present not only on the surface of the coating layer but also inside the coating layer.

As described above, the present inventors have focused on mainly changing electric resistance "R" in the equation: $\tau=R\times C$, and achieved the present invention. The relaxation time of the carrier is controlled by changing the electric resistance R by the method which is completely different from the conventional methods.

Therefore, the carriers, in which the coating layer is formed on the surface of the core material particles, have various relaxation times, even though physical properties such as carrier resistance are the same. The carrier adhesion can be drastically prevented by controlling the relaxation time. Then, the carrier used in the developing system, in which direct current voltage is applied as a developing bias, is significantly effective to prevent the carrier adhesion and background smear, and to improve image density.

In the present invention, the relaxation time of the resin-coated carrier can be measured using a device shown in FIG. 1. FIG. 1 is a schematic view of a measurement device for measuring a relaxation time of a carrier. The reference number 1 denotes a cell made of aluminium having a sample-holding recess part 1*a* of which depth is 0.3 mm. In figure, 4 denotes a detection part (probe) of a non-contact electrometer, 5 denotes a non-contact electrometer. A resin-coated carrier 2 is heaped in the sample-holding recess part 1*a* of the cell 1, and scraped off with a metal blade to prepare a sample for measuring a relaxation time. In the measurement, for the depth "d" of the cell 1 to suitably correspond to a space between a developing photoconductor of an image forming apparatus and a developing sleeve of a developing apparatus, the depth "d" is preferably 0.1 mm to 2 mm. The carrier surface loaded in the cell 1 is positively-charged (an arrow in figure) by sweeping a corona charger applied with electric pressure of +5 kV at 150 mm/sec in normal temperature and normal humidity (24° C., 60% RH). A charge potential $V_0$ is measured at the moment immediately after the sample is charged (t=0 second), and an electric potential of from 0 second to the time elapsed is measured, and electric potential data after 120 seconds ($V_1$) is measured. A non-contact electrometer (MODEL344 by TREK INC. 6000B-8 as a probe) is used to measure a charge potential.

In the charged carrier, the following Equation (1) holds:

$$V = V_0 e^{-\frac{t}{RC}} = V_0 e^{-\frac{t}{\tau}} \quad \text{Equation (1)}$$

wherein V is a surface electric potential at t seconds after charging, $V_0$ is a charge potential at the moment immediately after a carrier is charged (t=0 second), R is an electric resistance of the carrier, C is a capacity of the carrier, and $\tau$ is a relaxation time of the carrier.

Next, Equation (1) is changed to Equation (2), and the surface electric potential $V_0$ at t=0, and a surface electric potential data $V_1$ at a predetermined time after charging, for example, 120 seconds (t=120) after charging is measured to obtain a relaxation time $\tau$ from Equation (2).

$$\frac{V}{V_0} = e^{\frac{-t}{\tau}} \quad \text{Equation (2)}$$

Figure 2:
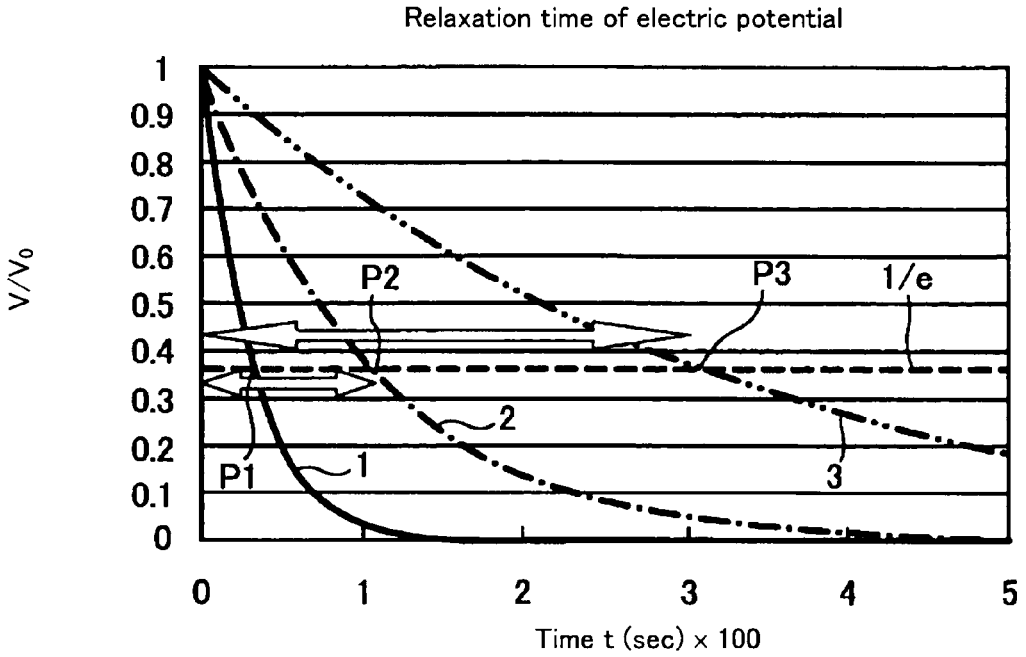
FIG. 2 shows a graph illustrating a relation between an electric potential ratio of a carrier ($V/V_0$) and a decay time for explaining the relaxation time of the carrier.

The discharge property of the carrier is found by plotting ($V_1/V_0$) on an ordinate axis and plotting the time elapsed "t" on an abscissa axis from the relation in Equation (2), and then a relaxation time $\tau$ can be obtained from the discharge property. FIG. 2 shows a graph illustrating a discharge property of the carrier. The curve 1 shows the carrier having a short relaxation time, the curve 2 shows the carrier having a middle relaxation time, and the curve 3 shows the carrier having a long relaxation time. From FIG. 2, the time elapsed "t" in the equation ($V_1/V_0$)=1/e (=0.3678) is found, that is, "t" at P1, P2 and P3 as shown in FIG. 2 is found to be "$\tau$=t", which is the relaxation time of the carrier plotting each curve. Thus, the time elapsed "t" can be easily obtained.

Of the thus measured carriers, as described later, the carrier having a relaxation time $\tau$ of 150 seconds to 800 seconds generates less carrier adhesion. More preferably, the carrier having a relaxation time $\tau$ of 200 seconds to 700 seconds generates less carrier adhesion. The carrier having a relaxation time $\tau$ of less than 150 seconds easily generates the induced charge type carrier adhesion. The carrier having a relaxation time $\tau$ of 800 seconds or more easily generates the counter-charge type carrier adhesion.

The carrier of the present invention contains core material particles having magnetism and a resin layer coated on the surfaces of the core material particles. It is important to adjust the diameters of the carriers and the diameters of the core material particles which are the skeletons of the carriers. The carrier used in the developing method in the present invention has a weight average particle diameter Dw of 20 μm to 45 μm. When the weight average particle diameter Dw is more than 45 μm, carrier adhesion is less likely to occur, but a toner is not faithfully developed to a latent electrostatic image. Thus, the variation of dot diameters may be increased and granularity (roughness) is decreased.

The carrier having a weight average particle diameter Dw of less than 20 μm rapidly increases carrier adhesion, because small magnetized particles are generated everywhere in a magnetic brush.

Moreover, when the resin coated carrier particles having a weight average particle diameter Dw of 22 μm to 32 μm, and a sharp particle size distribution, in which the resin contains 80% by weight and more preferably 82% by weight or more, of particles having a particle diameter of less than 36 μm, and 90% by weight or more of particles having a particle diameter of less than 44 μm, the variations of magnetizations in the carrier particles are decreased, and the carrier adhesion can be drastically prevented by applying direct current bias as a developing method.

Particularly, when the resin coated carrier particles having a sharp particle size distribution, in which the resin contains 0% by weight to 7% by weight of particles having a particle diameter of less than 20 μm, 80% by weight to 100% by weight of particles having a particle diameter of less than 36 μm, and 90% by weight to 100% by weight of particles having a particle diameter of less than 44 μm, the variations of magnetizations in the carrier particles are decreased so as to drastically prevent carrier adhesion.

In the present invention, the weight average particle diameters Dw of the carrier and the core material particles are found on the basis of the particle size distribution of the particles measured on a number basis i.e. the relation between the number based frequency and the particle diameter. In this case, the weight average particle diameter Dw is represented by Equation (3):

$$Dw=\{1/\Sigma(nD^3)\}\times\{\Sigma(nD^4)\} \quad \text{Equation (3)}$$

where D represents a typical particle diameter (μm) of particles residing in each channel, and "n" represents the number of particles residing in each channel. It should be noted that each channel is a length for equally dividing the range of particle diameters in the particle size distribution chart, and 2 μm can be employed for each channel in the present invention.

For the typical particle diameter of particles residing in each channel, the lower limit value of particle diameters of the respective channels can be employed. For a particle size analyzer used for measuring the particle size distribution in the present invention, a micro track particle size analyzer (Model HRA9320-X100, manufactured by Honewell Corp.) is used. The evaluation conditions are as follows.

(I) Scope of particle diameters: 100 μm to 8 μm (II) Channel length (width): 2 μm (III) Number of channels: 46

(IV) Refraction index: 2.42

Moreover, the resin coated carrier particles having a weight average particle diameter Dw of 22 μm to 32 μm, and a sharp particle size distribution, in which the resin contains 80% by weight or more and more preferably 82% by weight or more, of a particle diameter of less than 36 μm, and 90% by weight or more of a particle diameter of less than 44 μm. The variation of magnetization in each carrier particle is decreased, and carrier adhesion can be drastically prevented by a developing method of applying direct bias.

The carrier of the present invention preferably has a sharp particle size distribution and uniform granularity. The carrier and the core material particles having controlled weight average particle diameter Dw and number average particle diameter Dp are preferably used.

In addition, the number average particle diameters Dp of the carrier or the core material particles are determined according to the particle diameter distribution measured on a number standard. The number average particle diameter Dp is determined by Equation (4):

$$Dp=(1/N)\times\{\Sigma nD\} \quad \text{Equation (4)}$$

where N represents the total number of particles measured, "n" represents the total number of particles present in each channel and D represents the minimum particle diameter of the particles present in each channel (2 μm).

The particles size distribution of the carrier is measured on a micro track particle size analyzer (Model HRA9320-X100 produced by Honewell Corp.). The evaluation conditions are as above-described (I) to (IV).

The carrier of the present invention needs a specific magnetization in order to form a magnetic brush. The magnetization amount of the carrier is preferably 40 emu/g to 100 emu/g, and more preferably 50 emu/g to 90 emu/g, when a 1,000 Oersted magnetic field is applied thereon. The magnetization amount of less than 40 emu/g may easily generate carrier adhesion. The magnetization amount of more than 100 emu/g may generate strong trails of magnetic brush.

The magnetic moment of a carrier can be measured as follows. Carrier core material particles weighing 1.0 g are loaded in a cylindrical cell of a B-H tracer (BHU-60, manufactured by Riken Denshi Co., Ltd.), and the cylindrical cell was set to the tracer. A magnetic field is applied thereto and gradually increased up to 3,000 Oersted, and is gradually decreased to 0 Oersted. Then, a reverse magnetic field is applied and gradually increased up to 3,000 Oersted. After slowly decreasing the magnetic field until it reaches 0 Oersted, it is again increased in the first direction. A B-H curve can be illustrated with this means, and the magnetic moment at a magnetic field of 1,000 Oersted can be given with the curve.

The magnetization amount of the carrier is basically determined by the magnetic material for core material particles.

Examples of core materials used for particles, which can have a magnetization amount of 40 emu/g or more in the carrier of the present invention when a 1,000 Oersted magnetic field is applied thereon, include ferromagnetic materials such as irons and cobalts, magnetites, hematites, Li ferrites, Mn—Zn ferrites, Cu—Zn ferrites, Ni—Zn ferrites, Ba ferrites and Mn ferrites. In this case, a ferrite is a sintered substance which can be usually represented by Formula (1):

$$(MO)x(NO)y(Fe_2O_3)z \quad \text{Formula (1)}$$

where x+y+z=100 mol %; and M and N represent metal atoms such as Ni, Cu, Zn, Li, Mg, Mn, Sr and Ca, and are composed of a perfect mixture of divalent metal oxide and trivalent iron oxide. Preferred examples of core materials used for particles, which can have a magnetic moment (magnetization amount) of 40 emu/g or more when a 1,000 Oersted magnetic field is applied thereon, include irons, magnetites, Mn—Mg—Sr ferrites and Mn ferrites.

For the core material particles used in the carrier of the present invention, crushed particles of a magnetic material can be used. When the core material particles are made of ferrite or magnetite, primarily granulated product of pre-sintered particles are classified and sintered, and the sintered particles are then classified into particulate powders having different particle size distributions, and a plurality of particulate powders are mixed, thereby obtaining the core material particles.

The method of classifying the core material particles is not particularly limited, may be suitably selected in accordance with the intended use, and examples thereof include conventional classification methods such as sieve machines, gravity classifiers, centrifugal classifiers and inertial classifiers. Of these, wind-force classifiers such as gravity classifiers, centrifugal classifiers, and inertial classifiers are preferable in terms of excellent productivity and easy change of classification point.

In the carrier used in the present invention, electric resistance property is also an important factor. The electric resistance Log R of the carrier of the present invention can be measured by the following method using a cell to which electric field of 1,000V/2 mm is applied as shown in FIG. 3.

Figure 3:
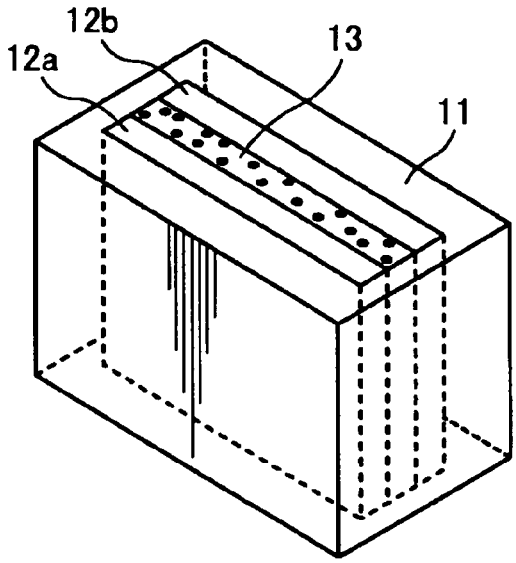
FIG. 3 is a perspective view of a cell for measuring a resistance of a carrier.

As shown in FIG. 3, a carrier 13 is loaded in a cell 11 formed of a fluorocarbon resin container which contains electrodes 12*a* and 12*b* therebetween having a distance of 2 mm and which are 2×4 cm in surface area, a DC voltage of 1,000 V is applied therebetween and then DC resistance is measured with a High Resistance Meter 4329A (4329A+LJK 5HVLVWDQFH OHWHU) manufactured by Hewlett-Packard Development Company, L.P. to determine the electric resistance Log R (Ω·cm). The packing degree of carrier particles when measuring the resistance is such that after the cell 11 is filled to the brim with the carrier 13, the cell 11 is tapped for 20 times, and then the carrier particles are scraped off along the brim of the cell 11 in a single action using a flat nonmagnetic-spatula so as to flat the top of the cell 11.

The carrier of the present invention preferably has a resistance (Log R) measured by the method of applying an electric field of 1,000V/2 mm to a cell, in the range of 11.0 Ω·cm to 17.0 Ω·cm, and more preferably 11.5 Ω·cm to 16.5 Ω·cm. When the resistance of the carrier is lower than 11.0 Ω·cm and the developing gap (the closest distance between a photoconductor and a developing sleeve) is narrowed, charge will be induced to the carrier particles, and carrier adhesion frequently occurs. On the other hand, the resistance of higher than 17.0 Ω·cm results in high edge effect, and the image density in a solid image part may be decreased. And when the resistance is higher than 17.0 Ω·cm, the charge having an opposite polarity to that of a toner tends to be accumulated, and carrier adhesion frequently occurs.

The resistance of the carrier can be controlled by adjusting the resistance and thickness of the coated resin layer on the core material particles. Moreover, the resistance of the carrier can be adjusted by adding an electroconductive fine powder to the coated resin layer. Examples of the electroconductive fine powders include, but are not limited to, metal such as electroconductive ZnO and Al, cerium oxide, alumina; a surface-hydrophobized metal oxide such as $SiO_2$, $TiO_2$; $SnO_2$ prepared by various methods or doped with various elements; borides such as $TiB_2$, $ZnB_2$ and $MoB_2$; silicon carbide; electroconductive polymers such as polyacetylene, polyparaphenylene, poly(paraphenylene sulphide)polypyrrole and polyethylene; and carbon blacks such as furnace black, acetylene black and channel black.

After loaded in a solvent or a resin solution for coating, the electroconductive fine powders can be prepared by being uniformly dispersed in a dispersing device using a medium such as a ball mill, a bead mill and a stirrer equipped with a high-speed rotating blade, and then coated on the core material particles using a dispersion for forming the coating layer to obtain a carrier.

The silicone resin for the coating layer is not particularly limited and may be suitably selected from among generally known silicone resins in accordance with the intended use, however, a silicone resin containing at least one of repeating units represented by the following formulas:

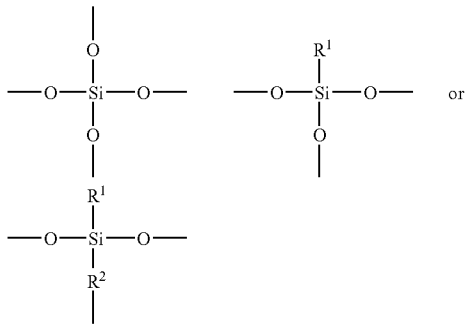

where $R^1$ represents an hydrogen atom, a halogen atom, a hydroxy group, a methoxy group, a lower alkyl group having 1 to 4 carbon atoms or an aryl group (for example, phenyl group, and tolyl group); and $R^2$ represents an alkylene group having 1 to 4 carbon atoms or an arylene group (for example, phenylene group).

The number of carbon atoms of the aryl group is preferably 6 to 20, and more preferably 6 to 14. Examples of the aryl groups include, besides benzene-derived aryl groups (phenyl groups), condensation polycyclic aromatic hydrocarbon-derived aryl groups such as naphthalene, phenanthrene, and anthracenes; and chained polycyclic aromatic hydrocarbon-derived aryl groups such as biphenyl and terphenyl. The aryl groups may be substituted by various substituent groups.

The number of carbon atoms of the arylene group is preferably 6 to 20, and more preferably 6 to 14. Examples of the arylene groups include, besides benzene-derived arylene groups (phenyl groups), condensation polycyclic aromatic hydrocarbon-derived arylene groups such as naphthalene, phenanthrene, and anthracenes; and chained polycyclic aromatic hydrocarbon-derived arylene groups such as biphenyl and terphenyl. The arylene groups may be substituted by various substituent groups.

As the silicone resin, a straight silicone resin may be used. For the straight silicone resins, commercially available ones may be used and examples thereof include KR271, KR272, KR282, KR252, KR255, and KR 152 (all manufactured by Shin-Etsu Chemical Co., Ltd.); and SR2400 and SR2406 (all manufactured by DOW CORNING TORAY SILICONE CO., LTD.).

As the silicone resin, a modified silicone resin may be used. Examples thereof include epoxy-modified silicone resins, acrylic-modified silicone resins, phenol-modified silicone resins, urethane-modified silicone resins, polyester-modified silicone resins and alkyd-modified silicone resins.

For the modified silicone, commercially available modified ones may be used and examples thereof include epoxy modified products: ES-1001N, acrylic-modified silicone resins: KR-5208, polyester-modified products: KR-5203, alkyd-modified products: KR-206, urethane-modified products: KR-305 (manufactured by Shin-Etsu Chemical Co., Ltd.) and epoxy modified products: SR2115 and alkyd-modified products: SR2110 (manufactured by DOW CORNING TORAY SILICONE CO., LTD.).

For the coating layers, styrene resins such as polystyrene, polychlorostyrene, poly(α-methylstyrene), styrene-chlorostyrene copolymers, styrene-propylene copolymers, styrene-butadiene copolymers, styrene-vinylchloride copolymers, styrene-vinylacetate copolymers, styrene-maleic acid copolymers, styrene-acrylic acid ester copolymers (such as styrene-methyl acrylate copolymer, styrene-ethyl acrylate copolymer, styrene-butyl acrylate copolymer, styrene-octyl acrylate copolymer, and styrene-phenyl acrylate copolymer); styrene-methacrylic acid ester copolymers (such as styrene-methyl methacrylate copolymer, styrene-ethyl methacrylate copolymer, styrene-butyl methacrylate copolymer, and styrene-phenyl methacrylate copolymer); styrene-α-chloromethyl acrylate copolymers, styrene-acrylonitrile-acrylic acid ester copolymers; epoxy resins, polyester resins, polyethylene resins, polypropylene resins, ionomer resins, polyurethane resins, ketone resins, ethylene-ethyl acrylate copolymers, xylene resins, polyamide resins, phenol resins, polycarbonate resins, melamine resins, and fluorine resins may be used alone or in combination with the above-described silicone resins.

The method for forming a coating layer on surfaces of the core material particles is not particularly limited, may be suitably selected in accordance with the intended use, and examples thereof include a spray-dry method, immersion method, and powder-coating method. Of these, a method using a fluidized bed coating apparatus is particularly effective in forming a uniform coating layer.

The thickness of the coating layer is preferably 0.02 μm to 1 μm, and more preferably 0.03 μm to 0.8 μm. The thickness of the coating layer is extremely thinner, and thus the particle diameter of the carrier with a coating layer formed on the surface of the core material particles is substantially equal to those of the core material particles.

The carrier having excellent durability can be obtained by containing an aminosilane coupling agent in the coating layer. Examples of the aminosilane coupling agent include compounds represented by the following formulas:

| | |
|---|---|
| $H_2N(CH_2)_3Si(OCH_3)_3$ | MW 179.3 |
| $H_2N(CH_2)_3Si(OC_2H_5)_3$ | MW 221.4 |
| $H_2NCH_2CH_2CH_2Si(CH_3)_2(OC_2H_5)$ | MW 161.3 |
| $H_2NCH_2CH_2CH_2Si(CH_3)(OC_2H_5)_2$ | MW 191.3 |
| $H_2NCH_2CH_2NHCH_2Si(OCH_3)_3$ | MW 194.3 |
| $H_2NCH_2CH_2NHCH_2CH_2CH_2Si(CH_3)(OCH_3)_2$ | MW 206.4 |
| $H_2NCH_2CH_2NHCH_2CH_2CH_2Si(OCH_3)_3$ | MW 224.4 |
| $(CH_3)_2NCH_2CH_2CH_2Si(CH_3)(OC_2H_5)_2$ | MW 219.4 |
| $(C_4H_9)_2NC_3H_6Si(OCH_3)_3$ | MW 291.6 |

The content of the aminosilane coupling agent in the coating layer is preferably 0.001% by weight to 30% by weight.

The bulk density of the core material particles is preferably 2.15 g/cm$^3$ to 2.70 g/cm$^3$, and more preferably 2.25 g/cm$^3$ to 2.60 g/cm$^3$. When the core material particles become porous or have large surface irregularities and have a bulk density of less than 2.15 g/cm$^3$, the substantial magnetization value per particle is reduced even when the magnetization (emu/g) is large, and thus it is disadvantageous to carrier adhesion.

The bulk density of the core material particles can be increased by raising the sintering temperature. However, when the sintering temperature is raised, the core material particles are easily fused to each other and are hardly pulverized, and thus the core material particles preferably have a bulk density of 2.7 g/cm$^3$ or less, and more preferably 2.6 g/cm$^3$ or less.

The bulk density of the core material particles can be measured in accordance with, for example, the metal powder-appearance density testing method (JIS Z2504) as follows. First, core material particles are naturally let out from an orifice having a diameter of 2.5 mm, and the core material particles are poured into a stainless cylindrical vessel of 25 cm$^3$ in volume which is located beneath the orifice until the cylindrical vessel was filled to the brim with the core material particles. Then, the core material particles are scraped off along the brim of the vessel in a single action using a flat nonmagnetic-spatula so as to flat the brim of the vessel.

When core material particles are hard to let out from an orifice having a diameter of 2.5 mm, the core material particles were naturally let out from an orifice having a diameter of 5 mm. The weight of the core material particles per 1 cm$^3$ is obtained by dividing the weight of the core material particles poured into the vessel by the volume of the vessel 25 cm$^3$. This is defined as the bulk density of the core material particles.

(Developer)

The developer of the present invention contains a toner and the carrier of the present invention. The toner preferably has a charge amount of 15 μc/g to 30 μc/g when the toner coverage on the carrier is 50%. When the toner has a charge amount of 30 μc/g or less, the accumulation of counter-charge is reduced and less carrier adhesion is more suitably achieved. The toner having a charge amount of less than 15 μc/g is not preferable, because background smear easily occurs.

Figure 4:
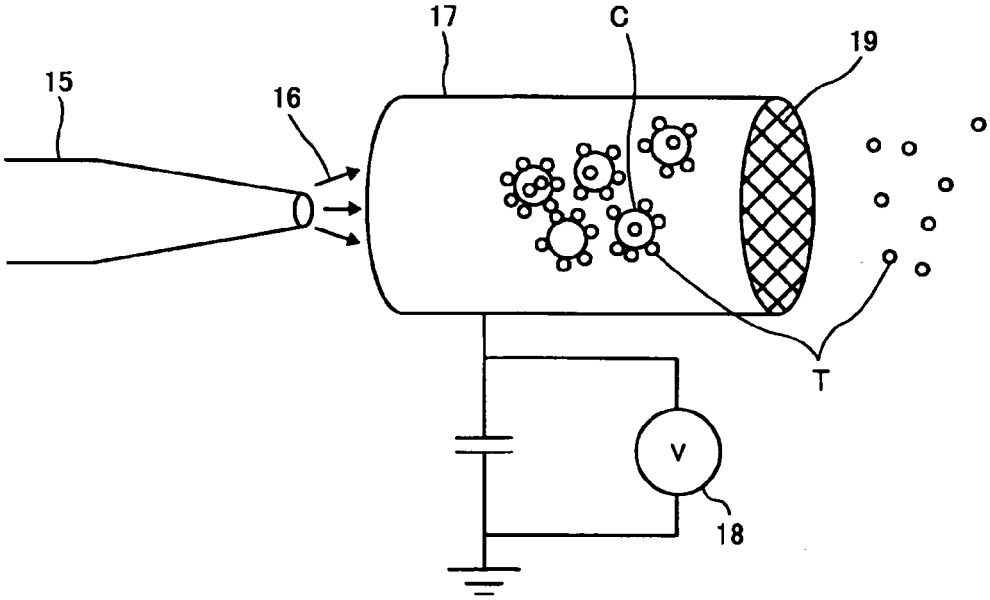
FIG. 4 is a schematic view of a measurement device for measuring a charge amount of a toner in a carrier.

Charge amount of a toner in a developer can be measured by the following method. FIG. 4 shows a schematic view of an example of a measurement device for measuring a charge amount of a toner in a carrier. In FIG. 4, 15 denotes a nozzle configured to spray a compressed nitrogen gas 16 into a blow-off cage 17 in order to blow out a toner T adhering to a carrier C outside the cage 17. 18 denotes an electrometer configured to measure an electric potential in the carrier inside the blow-off cage 17.

To measure the charge amount of a toner in a developer, a specific amount of developer, in which toners adhere on a carrier surface, is loaded in a conductive blow-off cage 17 equipped with stainless steel metal meshes 19 at the both ends. The size of openings of the meshes 19 is between the diameters of the toner T and that of the carrier C, (openings of 20 μm), and thus the toner particles T can go through the meshes 19. When the compressed nitrogen gas 16 (1 kgf/cm$^2$) is sprayed into the blow-off cage 17 from a nozzle 15 for 60 seconds in order to blow out the toner T outside the cage, and then, carrier particles C is charged opposite to the toner. A charge amount (Q) and mass (M) of the blown-off toner are measured, and the charge amount per unit mass, Q/M, is obtained. The measure of the charge amount of the toner is "μc/g." The coverage of toner on the carrier surface can be calculated by the Equation (5).

$$\text{Coverage (\%)}=(Wt/Wc)\times(\rho c/\rho t)\times(Dc/Dt)\times(1/4)\times 100 \qquad \text{Equation (5)}$$

wherein Dc is a weight average particle diameter of carrier (μm), Dt is a weight average particle diameter of toner (μm), Wt is a weight of toner (g), Wc is a weight of carrier (g), ρt is a true density of toner (g/cm$^3$), and pc is a true density of carrier (g/cm$^3$).

<Toner>

The toner used in the present invention contains a binder resin primarily made of a thermoplastic resin, a colorant, a charge controlling agent and a releasing agent, further contains other components as necessary.

The toner may be produced by various toner production methods including a polymerization method and a granulation method, and may be in either an amorphous form or spherical form. Either magnetic toner or non-magnetic toner can be used.

—Binder Resin—

A binder resin is not particularly limited and may be suitably selected in accordance with the intended use. Examples of styrene binder resins include homopolymers of styrenes or styrene-substitutes such as polystyrene and polyvinyltoluene; poly-p-styrene, styrene-p-chlorostyrene copolymers, and copolymers of styrenes, such as styrene-propylene copolymers, styrene-vinyltoluene copolymers, styrene-methyl acrylate copolymers, styrene-ethyl acrylate copolymers, styrene-butyl acrylate copolymers, styrene-methyl methacrylate copolymers, styrene-ethyl methacrylate copolymers, styrene-butyl methacrylate copolymers, styrene-α-chloromethyl methacrylate copolymers, styrene-acrylonitrile copolymers, styrene-vinyl methyl ether copolymers, styrene-vinyl methyl ketone copolymers, styrene-butadiene copolymers, styrene-isoprene copolymers, styrene-maleic acid copolymers and styrene-maleic acid ester copolymers; acrylic binders such as polymethyl methacrylate, polybutyl methacrylate; polyvinyl chloride, polyvinyl acetate, polyethylene, polypropylene, polyester resins, polyurethane, epoxy resins, polyvinyl butyral, polyacrylic acid resins, rosins, modified rosins, terpene resins, phenol resins, alicyclic or aliphatic hydrocarbon resins, aromatic petroleum resins, chlorinated paraffins, and paraffin waxes. Of these, polyester resins and epoxy resin are particularly preferred. These may be used alone or in combination.

The polyester resins can reduce the melt viscosity while ensuring the storage stability of a toner, as compared to styrene resins and acrylic resins. Such polyester resins can be obtained by, for example, a polycondensation reaction between an alcohol and a carboxylic acid.

Examples of alcohols include polyethylene glycol, diethylene glycol, triethylene glycol, 1,2-propylene glycol, 1,3-propylene glycol, 1,4-propylene glycol, neopentyl glycol, diols such as 1,4-butene diol; etherified bisphenols such as 1,4-bis(hydroxymethyl)cyclohexane, bisphenol A, hydrogenated bisphenol A, polyoxy-ethylenated bisphenol A, polyoxy-propylenated bisphenol A; divalent alcohol monomers in which each of the above-noted alcohol components is substituted by a saturated or unsaturated hydrocarbon group having 3 to 22 carbon atoms, other divalent alcohol monomers; and trivalent or more high-alcohol monomers such as sorbitol, 1,2,3,6-hexane tetrol, 1,4-sorbitan, pentaerythritol, dipentaerythritol, tripentaerythritol, sucrose, 1,2,4-butanetriol, 1,2,5-pentanetriol, glycerol, 2-methylpropane triol, 2-methyl-1,2,4-butanetriol, trimethylol ethane, trimethylol propane, and 1,3,5-trihydroxymethyl benzene.

Examples of carboxylic acids include monocarboxylic acids such as palmitic acid, stearic acid, and oleic acid; maleic acid, fumaric acid, mesaconic acid, citraconic acid, terephthalic acid, cyclohexane dicarboxylic acid, succinic acid, adipic acid, sebacic acid, malonic acid, divalent organic acid monomers that each of the above-noted carboxylic acid components is substituted by a saturated or unsaturated hydrocarbon group having 3 to 22 carbon atoms, anhydrides thereof, dimer acids containing a lower alkyl ester and a linolenic acid; 1,2,4-benzene tricarboxylic acid, 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylenecarboxypropane, tetra(methylencarboxyl) methane, 1,2,7,8-octanetetracarboxylic enball trimer acid, and trivalent or more polyvalent carboxylic acid monomers such as anhydrides of these acids.

For an epoxy resin, a polycondensation product between bisphenol A and epichlorohydrin etc, may be used, and examples of commercially available epoxy resins include Epomic R362, R364, R365, R366, R367, and R369 (all manufactured by MITSUI OIL CO., LTD.); Epotote YD-011, YD-012, YD-014, YD-904, and YD-017 (all manufactured by Tohto Kasei Co., Ltd.); and Epocoat 1002, 1004, and 1007 (all manufactured by Shell Chemicals Japan Ltd.).

—Colorant—

The colorant is not particularly limited and may be suitably selected in accordance with the intended use. Examples thereof include carbon black, ramp black, iron black, ultramarine blue, nigrosine staining, aniline blue, phthalocyanine, hansa yellow G, rhodamine 6G lake, calco oil blue, chrome yellow, quinacridone, benzin yellow, rose Bengal, triarylmethane dyes, monoazos, disazos, and other types of dyes and pigments. Each of these colorants may be used alone or in combination.

The toner may be a magnetic toner containing a magnetic material. The magnetic material can employ ferromagnetic materials, such as iron and cobalt; and fine particles such as magnetite fine particles, hematite fine particles, Li ferrite fine particles, Mn—Zn ferrite fine particles, Cu—Zn ferrite fine particles, Ni—Zn ferrite fine particles and Ba ferrite fine particles.

—Charge Controlling Agent—

In order to sufficiently control the frictional charge of the toner, a charge controlling agent can be contained. Example thereof include metallic complex amino compounds such as a metal complex salt of monoazo dye, nitrohumic acid and the salt thereof, salicylic acid, naphthoic acid or dicarboxylic acid metallic complex of Co, Cr or Fe, amino compound, quaternary ammonium compound, and organic dye.

—Releasing Agent—

The releasing agent is not particularly limited, may be suitably selected in accordance with the intended use, and examples thereof include low-molecular weight polypropylenes, low-molecular weight polyethylenes, carnauba waxes, microcry stalline waxes, jojoba waxes, rice waxes and montan acid waxes. Each of these may be used alone or in combination.

—Additives—

The toner may contain other additives. To obtain a high-quality image, it is preferable to impart flowability to the toner. To impart flowability to the toner, it is typically effective to externally add fine particles such as hydrophobized metal oxide particles, lubricant particles, etc. as a flowability improving agent, and metal oxides, organic resin fine particles, metal soaps, etc. can be used as additives. Specific examples of the additives include fluorine resins such as polytetrafluoroethylene; lubricants such as zinc stearate, abrasives such as cerium oxide, silicon carbide; flowability imparting agents such as $SiO_2$ and $TiO_2$ in which surface have been hydrophobized; caking inhibitors; and surface-treated products thereof. To improve flowability of the toner, a hydrophobized silica is particularly preferably used.

The weight average particle diameter of the toner Dw used in the present invention is preferably 3.0 μm to 9.0 μm, and more preferably 3.5 μm to 7.5 μm.

The weight average particle diameter of the toner can be measured by using, for example, Coulter Counter (manufactured by Beckman Coulter, Inc.).

The amount of the toner to the carrier is preferably 2 parts by weight to 25 parts by weight, and more preferably 3 parts by weight to 20 parts by weight per 100 parts by weight of the carrier.

(Electrophotographic Developing Method)

An electrophotographic developing method of the present invention include a developing step in which a toner is supplied from a developer containing a carrier and the toner to a surface of a photoconductor on which a latent electrostatic image is formed, and the latent electrostatic image is developed so as to form a visible image, wherein the carrier is the carrier of the present invention.

When the toner is supplied from the developer to the photoconductor, a direct current voltage as a developing bias is applied to between the photoconductor and the developing sleeve, thereby obtaining sufficient image density, particularly, improving granularity in highlight.

Moreover, as a developing bias only a direct current voltage is preferably applied to significantly prevent the carrier adhesion and edge effect and to increase the margin to the background smear. Thus, the coverage of toner on the carrier can be increased and the charge amount of the toner and developing bias can be decreased, and image density can be increased.

The process cartridge having a photoconductor, a charge brush configured to charge a surface of the photoconductor, a developing part in which a latent electrostatic image formed on the surface of the photoconductor is developed using the developer, and a blade configured to clean the developer remaining on the surface of the photoconductor, can be adopted in an electrophotographic system.

The image forming method of the present invention includes at least charging a surface of a photoconductor, exposing the charged surface of the photoconductor so as to form a latent electrostatic image, developing the latent electrostatic image using a toner so as to form a visible image, transferring the visible image to a recording medium, and fixing the transferred image on the recording medium, wherein the developing is performed by the electrophotographic developing method of the present invention.

Next, the electrophotographic developing method and electrophotographic developing apparatus of the present invention will be described in detail with reference to the drawings, however, these examples are described for explaining the present invention and are not intended to limit the scope of the present invention.

Figure 5:
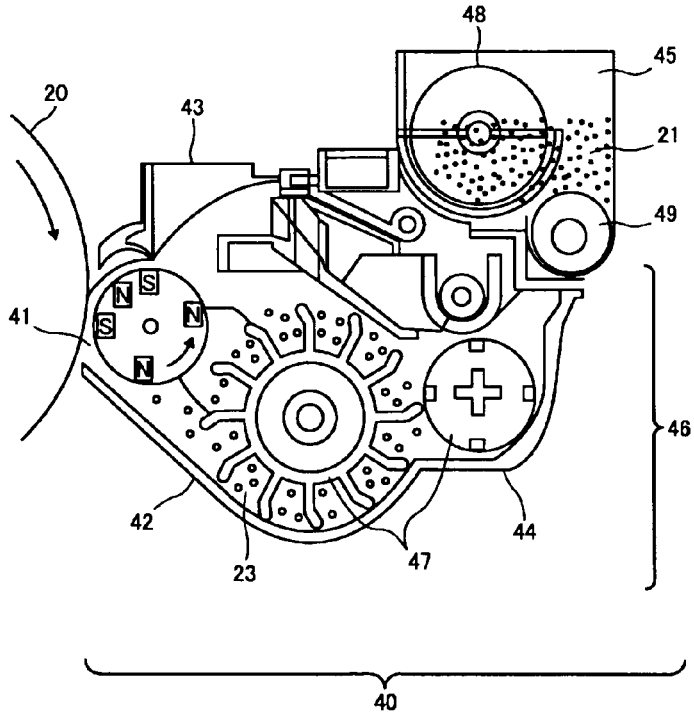
FIG. 5 is a schematic view showing one example of an image developing apparatus used in an electrophotographic developing method of the present invention.

FIG. 5 is a view schematically showing one example of a developing part in an electrophotographic developing apparatus used in the present invention to explain an electrophotographic developing method. In FIG. 5, an image developing apparatus 40 arranged so as to face a photoconductor drum 20 as a latent image bearing member, and the image developing apparatus 40 is predominantly-comprised of a developing sleeve 41 serving as a developer bearing member, a developer housing member 42, a doctor blade 43 serving as a regulating member, and a support case 44.

To the support case 44 which has an aperture on the side of the photoconductor 20, a toner hopper 45 serving as a toner housing part for housing a toner 21 inside thereof is jointed. In a developer housing part 46 which is located adjacent to the toner hopper 45 and is configured to house a developer containing the toner 21 and a carrier 23, a developer agitating mechanism 47 is provided, and the developer agitating mechanism 47 serves to agitate the toner 21 and the carrier 23, and to give frictional charge or separation charge to the toner.

Inside the toner hopper 45, a toner agitator 48 as a toner supplying unit which is rotated by a driving unit (not shown), and a toner supplying mechanism 49 are arranged. The toner agitator 48 and the toner supplying mechanism 49 are configured to send the toner 21 residing in the toner hopper 45 toward the developer housing part 46 while agitating the toner 21. In a space between the photoconductor 20 and the toner hopper 45, the developing sleeve 41 is arranged. The developing sleeve 41 which is driven to rotate in the direction indicated by the arrow in the figure by means of a driving unit (not shown) has a magnet (not shown) serving as a magnetic field generating unit which is inalterably located at a relative position to the image developing apparatus 40 inside of the developing sleeve 41 so as to form a magnetic brush of the carrier 23. The doctor blade 43 is integrally attached to the developer housing member 42 on the opposite position where the developer housing member 42 is attached to the support case 44. The regulating member (doctor blade) 43 is arranged, in this example, in a state where an interspace with a certain distance is kept between the edge of the doctor blade 43 and the outer circumference surface of the developing sleeve 41.

Using such an image developing apparatus in an unlimited manner, the image forming method of the present invention is carried out as follows. The toner 21 sent out from the inside of the toner hopper 45 by action of the toner agitator 48 and the toner supplying mechanism 49 is conveyed to the developer housing part 46. Then, the toner 21 is agitated by means of a developer agitating mechanism 47, and the agitation force gives the toner 21 desired frictional charge or separation charge, and the toner 21 is carried on the developing sleeve 41 together with the carrier 23 as a developer to be conveyed at the opposed position to the outer circumferential surface of the photoconductor 20, and then only the toner 21 is electrostatically bound to a latent electrostatic image formed on the surface of the photoconductor 20 to thereby form a visible image on the photoconductor 20.

Figure 6:
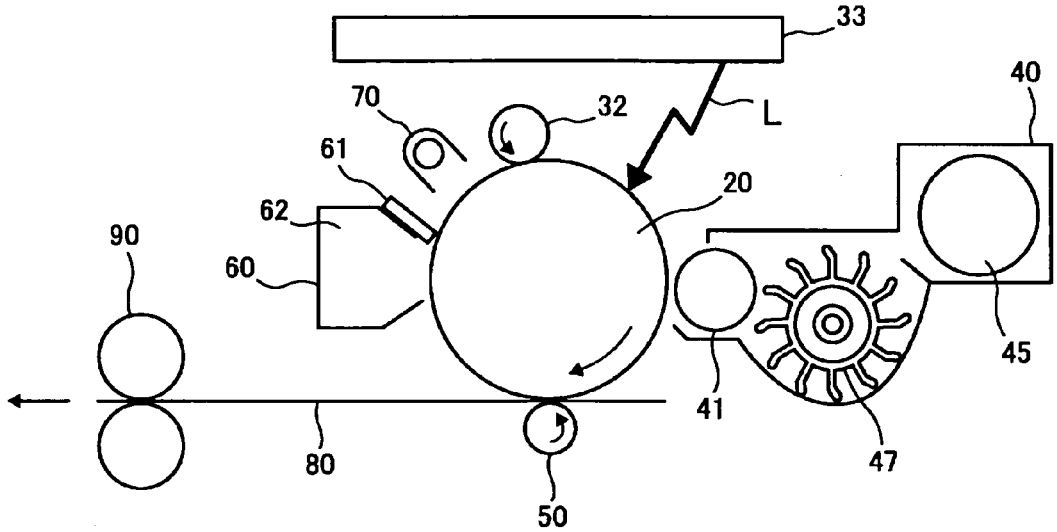
FIG. 6 is a schematic view showing one example of an image forming apparatus used in an image forming method of the present invention.

FIG. 6 is a cross-sectional view showing one example of an image forming apparatus equipped with the image developing apparatus. Around the drum-like photoconductor 20, a charge member 32, an image exposing system 33, the image developing apparatus 40, an image transfer roller 50, a cleaner 60, and a charge elimination lamp 70 are located. In this case, the surface of the charge member 32 is arranged in a noncontact state with the surface of the photoconductor 20 spacing approximately 0.2 mm, and when the photoconductor 20 is charged through the use of the charge member 32, the surface of the photoconductor 20 is charged with an electric field in which an alternate current component is superposed to a direct current component by use of a voltage application unit which is not shown in the charge member 32. With this configuration, it is possible to reduce nonuniformity of charge, and the surface of the photoconductor 20 can be effectively charged. The image forming method including a developing method is performed with the following operations.

A series of the image forming process can be explained using a negative-positive process. A photoconductor 20 typified by an organic photoconductor (OPC) having an organic photoconductive layer is charge-eliminated using a charge elimination lamp 70 and is uniformly negatively charged by a charge member 32 such as an electric charger and a charge roller to form a latent image by means of a laser beam L modulated according to image information and applied from a laser optical image exposure system 33 (in this case, the absolute value of the electric potential of exposed areas is lower than that of unexposed areas).

The laser beam is emitted from a semiconductor laser to scan the surface of the image bearing member, or photoconductor 20 in the direction of the rotational axis of the photoconductor 20 using a polygonal mirror in a shape of polygonal pole, which is rotating at a high speed to form a latent image on the photoconductor surface. The latent image formed in this way is developed using a developer which contains a mixture of a toner and a carrier and is supplied to a developing sleeve 41 serving as a developer bearing member in the image developing apparatus 40 to thereby form a visible image. When a latent image is developed, a developing bias of an appropriate amount of direct current voltage or an alternate current voltage superposed to the direct current voltage is applied from a voltage applying mechanism (not shown) through the developing sleeve 41 to areas inbetween exposed areas and unexposed areas on the photoconductor 20.

Meanwhile, a recording medium 80 (for example, a paper) is fed and sent from a sheet feeding mechanism (not shown) to be synchronized with the edge of an image at a position of a pair of resist rollers (not shown) to be sent inbetween the photoconductor 20 and a transfer roller 50 to thereby transfer a visible image onto the recording medium 80. At this point in time, it is preferable that an electric potential opposite to the polarity of the toner charge be applied as a transfer bias to the transfer roller 50. Then, the visible image thus transferred on the recording medium 80 is conveyed to a fixing unit 90 consisting of a heat and a pressure application roller and the visible image is fixed thereon with a fixing unit 90. The recording medium 80 will be then ejected after the visible image thereon has been fixed.

A residual toner remaining on the photoconductor 20 is collected to a toner collection chamber 62 within a cleaner 60 by action of a cleaning blade 61 as a cleaning member.

The collected toner particles may be conveyed to a developing part and/or a toner supplying part by a toner recycle unit (not shown), and reused.

The image forming apparatus is not limited to a black and white type containing one photoconductor 20 and one developing apparatus 40, but may be a full-color type in which plural, for example, four photoconductors 20, and plural developing apparatuses for respective colors of yellow, magenta, cyan and black, which correspond to the photoconductors 20 are arranged parallel along the feeding path of the recording medium 80.

EXAMPLES

Hereafter, the present invention will be further described in detail referring to specific examples, however, the present invention is not limited to the disclosed examples. It should be noted that "part" or "parts" represents "part by weight" or "parts by weight", and "%" represents "% by weight".

—Preparation of Toner—

| | |
|---|---|
| Polyester resin | 100 parts |
| Quinacridone magenta pigment | 3.5 parts |
| Fluorine-containing quaternary ammonium salt | 4 parts |

The compositions described above were sufficiently mixed by a blender, and the mixture was melted and kneaded by a biaxial extruder. The kneaded product was cooled, and then coarsely crushed by a cutter mill. Next, the coarsely crushed product was finely pulverized in a jet stream pulverizer, and then classified by an air classifier to obtain toner base particles having a weight average particle diameter of 5.8 μm and a true specific gravity of 1.20.

Next, to 100 parts of the obtained toner base particles, 1.5 parts of hydrophobized silica fine particles (R972 manufactured by Nippon AEROSIL CO., LTD.) were added, and then mixed to prepare a toner.

—Preparation Example of Carrier 1—

The following compositions were dispersed by a homomixer for 10 minutes to prepare a coating solution for coating layer.

| | |
|---|---|
| Silicone resin (SR2411 manufactured by DOW CORNING TORAY SILICONE CO., LTD., solid content of 20%) | 100 parts |
| $H_2N(CH_2)_3Si(OC_2H_5)_3$ | 5 parts |
| Fine alumina particles (volume average particle diameter: 0.35 μm) | 20 parts |
| Toluene | 300 parts |

Next, 5 kg of the core material particles (a) (Cu—Zn ferrite particles having a particle diameter of 38.9 μm and magnetization value at 1 kOe of 56 emu/g) having properties as shown in Table 1 were coated on the surfaces thereof with the coating solution for coating layer using a fluidized bed coating apparatus under an atmosphere of 90° C. at a rate of 30 g/min, and then heated at 230° C. for 2 hours to prepare Carrier A (0).

Carrier A (0) had a coating layer of 0.45 μm-thick, a resistance (Log R) of 16.3 Ω·cm as measured when applied with 1,000V in a cell as shown in FIG. 3 (hereinafter referred to as measured at 1,000V/2 mm) and a relaxation time of 1,195 seconds as measured by the method as shown in FIG. 1. The thickness of the coating layer was adjusted by the amount of the coating solution for coating layer.

Next, 500 g of Carrier A (0) was loaded in a tumbler shaker mixer and stirred, and then 2 g of carrier was taken out every 5 minutes to measure the relaxation time of the carrier "τ" by the method as shown in FIG. 1. Carrier A (5) means the carrier taken out after 5 minute, Carrier A (10) means the carrier taken out after 10 minute, and the like. The relaxation times of respective carriers were: Carrier A (5)=1,054 seconds, Carrier A (10)=927 seconds, Carrier A (15)=828 seconds, Carrier A (20)=705 seconds and Carrier A (30)=578 seconds as shown in Table 3-1.

The carrier had a resistance (Log R) of 16.4 Ω·cm at 30 minutes later as shown in Table 3-2.

—Preparation Example of Carrier 2—

Carrier B (0) was prepared in the same manner as in Preparation Example of Carrier 1, except that the core material particles were changed to core material particles (b) (Cu—Zn ferrite particles having a particle diameter of 27.9 μm and magnetization value at 1 kOe of 57 emu/g). Carrier B (0) had a coating layer of 0.32 μm-thick, a resistance (Log R) of 16.2 Ω·cm measured at 1,000V/2 mm, and a relaxation time of 1,127 seconds as measured by the method as shown in FIG. 1. The thickness of the coating layer was adjusted by an amount of the coating solution for coating layer. Carrier B (0) was loaded in a tumbler shaker mixer and stirred, and then 2 g of carriers were taken out every 5 minutes to measure the relaxation time of the carrier "τ" by the method as shown in FIG. 1.

The relaxation times of the respective carriers were Carrier B (5)=976 seconds, Carrier B (10)=844 seconds, Carrier B (15)=705 seconds, Carrier B (20)=601 seconds and Carrier B (30)=474 seconds as shown in Table 3-1.

The carrier had a resistance (Log R) of 16.0 Ω·cm at 30 minutes later as shown in Table 3-2.

—Preparation Example of Carrier 3—

Carrier C (0) was prepared in the same manner as in Preparation Example of Carrier 1, except that the core material particles were changed to core material particles (c) (Mn—Mg—Sr ferrite particles having a particle diameter of 27.6 μm and magnetization value at 1 kOe of 71 emu/g). Carrier C (0) had a coating layer of 0.32 μm-thick, a resistance (Log R) of 16.4 Ω·cm measured at 1,000V/2 mm, and a relaxation time of 1,103 seconds as measured by the method as shown in FIG. 1. The thickness of the coating layer was adjusted by an amount of the coating solution for coating layer.

In the same manner as in Preparation Example of Carrier 1, Carrier C (0) was loaded in a tumbler shaker mixer and stirred, and then 2 g of carriers were taken out every 5 minutes to measure the relaxation time of the carrier "τ" by the method as shown in FIG. 1.

The relaxation times of the respective carriers were Carrier C (5)=962 seconds, Carrier C (10)=794 seconds, Carrier C (15)=623 seconds, Carrier C (20)=554 seconds and Carrier C (30)=412 seconds as shown in the column of Carrier C in Table 3-1. The carrier had a resistance (Log R) of 16.2 Ω·cm at 30 minutes later as shown in Table 3-2.

—Preparation Example of Carrier 4—

Carrier D (0) was prepared in the same manner as in Preparation Example of Carrier 1, except that the core material particles were changed to core material particles (d) (Mn ferrite particles having a particle diameter of 27.2 μm and magnetization value at 1 kOe of 75 emu/g). Carrier D (0) had a coating layer of 0.33 μm-thick, a resistance (Log R) of 16.2 Ω·cm measured at 1,000V/2 mm, and a relaxation time of 1,138 seconds as measured by the method as shown in FIG. 1. The thickness of the coating layer was adjusted by an amount of the coating solution for coating layer.

In the same manner as in Preparation Example of Carrier 1, Carrier D (0) was loaded in a tumbler shaker mixer and stirred, and then 2 g of carriers were taken out every 5 minutes to measure the relaxation time of the carrier "τ" by the method as shown in FIG. 1.

The relaxation times of the respective carriers were Carrier D (5)=934 seconds, Carrier D (10)=742 seconds, Carrier D (15)=554 seconds, Carrier D (20)=474 seconds and Carrier D (30)=377 seconds as shown in the column of Carrier D in Table 3-1.

The carrier had a resistance (Log R) of 16.0 Ω·cm at 30 minutes later as shown in Table 3-2.

—Preparation Example of Carrier 5—

Carrier E (0) was prepared in the same manner as in Preparation Example of Carrier 1, except that the core material particles were changed to core material particles (e) (magnetite particles having a particle diameter of 26.9 μm and magnetization value at 1 kOe of 74 emu/g), and that the amount of the coating solution was reduced by a factor of 3. Carrier E (0) had a coating layer of 0.08 μm-thick, a resistance (Log R) of 12.3 Ω·cm measured at 1,000V/2 mm and a relaxation time of 811 seconds as measured by the method as shown in FIG. 1.

In the same manner as in Preparation Example of Carrier 1, Carrier E (0) was loaded in a tumbler shaker mixer and stirred, and then 2 g of carriers were taken out every 5 minutes to measure the relaxation time of the carrier "τ" by the method as shown in FIG. 1. The relaxation times of the respective carriers were Carrier E (5)=578 seconds, Carrier E (10)=412 seconds, Carrier E (15)=241 seconds, Carrier E (20)=187 seconds and Carrier E (30)=122 seconds as shown in the column of Carrier E in Table 3-1. The carrier had a resistance (Log R) of 10.4 Ω·cm at 30 minutes later as shown in Table 3-2.

Table 1 shows properties of core material fine particles, Table 2 shows preparation examples of carriers, and Tables 3-1 and 3-2 show the relaxation times relative to stirring times by the tumbler shaker mixer and the carrier resistances.

TABLE 1

| | Core material particles | | | | |
|---|---|---|---|---|---|
| | (a) | (b) | (c) | (d) | (e) |
| Weight average particle diameter Dw (μm) | 38.9 | 27.9 | 27.6 | 27.2 | 26.6 |
| Resistance of core material LogR (Ωcm) | 8.4 | 8.5 | 8.2 | 7.6 | 6.9 |
| Magnetization emu/g (1kOe) | 56 | 57 | 71 | 75 | 74 |
| Bulk density (g/cm$^3$) | 2.35 | 2.45 | 2.36 | 2.40 | 2.40 |
| Composition of core material | Cu—Zn ferrite | Cu—Zn ferrite | Mn—Mg—Sr ferrite | Mn ferrite | magnetite |

TABLE 2

| Preparation Example of Carrier | Carrier | Core material particles | Weight average particle diameter (μm) | Dw/Dp | Amount of particles having a particle diameter of less than 20 μm (% by weight) | Amount of particles having a particle diameter of less than 22 μm (% by weight) | Amount of particles having a particle diameter of less than 36 μm (% by weight) | Amount of particles having a particle diameter of less than 44 μm (% by weight) | Carrier resistance LogR (Ωcm) |
|---|---|---|---|---|---|---|---|---|---|
| Preparation Example 1 | Carrier A | (a) | 39.3 | 1.21 | 0.2 | 0.9 | 44.6 | 75.3 | 16.3 |
| Preparation Example 2 | Carrier B | (b) | 28.5 | 1.14 | 4.7 | 12.1 | 88.3 | 97.0 | 16.2 |
| Preparation Example 3 | Carrier C | (c) | 27.8 | 1.12 | 4.8 | 13.0 | 91.3 | 98.1 | 16.4 |
| Preparation Example 4 | Carrier D | (d) | 27.7 | 1.12 | 4.9 | 13.4 | 90.4 | 98.4 | 16.2 |
| Preparation Example 5 | Carrier E | (e) | 27.4 | 1.1 | 4.8 | 13.7 | 92.5 | 98.6 | 12.3 |

TABLE 3-1

| | | Relaxation time (seconds) | | | | |
|---|---|---|---|---|---|---|
| | | Carrier A | Carrier B | Carrier C | Carrier D | Carrier E |
| Stirring time (minutes) | 0 | 1,195 | 1,127 | 1,103 | 1,138 | 811 |
| | 5 | 1,054 | 976 | 962 | 934 | 578 |
| | 10 | 927 | 844 | 794 | 742 | 412 |
| | 15 | 828 | 705 | 623 | 554 | 241 |
| | 20 | 705 | 601 | 554 | 474 | 187 |
| | 30 | 578 | 474 | 412 | 377 | 122 |

TABLE 3-2

| | Carrier A | Carrier B | Carrier C | Carrier D | Carrier E |
|---|---|---|---|---|---|
| Resistance (New/30 minutes later) LogR (Ωcm) | 16.3/16.4 | 16.2/16.0 | 16.4/16.2 | 16.2/16.0 | 12.3/10.4 |

Example 1

To 100 parts of Carrier A (20), 13.1 parts of a toner was added, and stirred by a ball mill for 5 minutes to produce a developer having a toner content of 11.6% by weight. The toner coverage on the carrier was 50%.

Examples 2 to 5 and Comparative Examples 1 to 7

The toner prepared in Preparation Example of Toner and respective carriers as shown in Table 4 were used to produce respective developers of Examples 2 to 5 and Comparative Examples 1 to 7, in which the toner coverage on the carrier was 50%.

Carrier B (20), Carrier C (20), Carrier D (20), Carrier E (20), Carrier A (0), Carrier A(15), Carrier B (0), Carrier C (0), Carrier D (0), Carrier E (0) and Carrier E (30) were respectively used in Examples 2, 3, 4, 5 and Comparative Examples 1, 2, 3, 4, 5, 6 and 7.

<Evaluation 1>

By using the respective developers of Examples 1 to 5 and Comparative Examples 1 to 7, images were formed, and the image quality was confirmed in the following procedures. Table 4 shows the evaluation results. The images were formed by Imagio Color 5000 (a digital color photocopier/printer complex unit manufactured by Ricoh Company Ltd.) under the following development conditions.

—Development Conditions—

Developing gap (the distance between a photoconductor and developing sleeve): 0.3 mm Doctor gap (the distance between a developing sleeve and doctor blade): 0.7 mm Linear speed of the photoconductor: 245 mm/sec The ratio of the linear speed of the developing sleeve to the linear speed of the photoconductor: 1.5

Writing density: 600 dpi

Charge potential (Vd): −750V

Electric potential of an image portion (solid image) after exposure: −100V

Developing bias: DC component −500V

The test method was as follows:

(1) Counter-Charge Type Carrier Adhesion

With setting the charge potential (Vd) to −750V, and the developing bias (Vd) to DC-400V, a background part (unexposed area) was developed, and the number of carrier particles adhering to an area of 30 cm$^2$ on the photoconductor was directly counted, thereby evaluated the respective developers as to the carrier adhesion in accordance with the following criteria.

[Evaluation Criteria]

A: Excellent

B: Good

C: Allowable

D: Poor (unallowable level)

(2) Induced Charge Type Carrier Adhesion

A solid image (30 mm×30 mm) was formed by Imagio Color 5000 (a digital color photocopier/printer multiple function processing machine, manufactured by Ricoh Company Ltd.) under the above development conditions. The number of carrier adhesion in the solid image was directly counted and the carrier adhesion was evaluated by the following criteria.

[Evaluation Criteria]

A: Excellent

B: Good

C: Allowable

D: Poor (unallowable level)

(5) Background Smear

The degree of smear of the background parts of the image was visually observed, and the respective developers were evaluated in accordance with the following criteria.

[Evaluation Criteria]

A: Very excellent

B: Excellent

C: Allowable

D: Poor (unallowable level).

(6) Carrier Adhesion after Running Output of 20,000 Sheets

The carrier adhesion on the respective developers after running output of 20,000 sheets of a 6% text image-area ratio chart while supplying a toner, were evaluated in the same manner as in (4) Granularity.

TABLE 4

| | Carrier | Resistance LogR (Ωcm) | Toner charge amount (μc/g) | Relaxation time (sec) | Carrier adhesion (counter charge type) | Carrier adhesion (black solid part) | Image density | Granularity | Initial background smear | Carrier adhesion after running output of 20,000 sheets |
|---|---|---|---|---|---|---|---|---|---|---|
| Example 1 | Carrier A (20) | 16.3 | 37 | 705 | B | A | 1.56 | B | A | B |
| Comparative Example 1 | Carrier A (0) | 16.3 | 38 | 1195 | D | A | 1.52 | D | D | D |
| Comparative Example 2 | Carrier A (15) | 16.3 | 37 | 828 | D | A | 1.6 | D | D | D |
| Example 2 | Carrier B (20) | 16.1 | 35 | 601 | A | A | 1.61 | A | A | A |
| Comparative Example 3 | Carrier B (0) | 16.2 | 36 | 1127 | D | A | 1.51 | D | D | D |
| Example 3 | Carrier C (20) | 16.3 | 34 | 554 | A | A | 1.63 | A | A | A |
| Comparative Example 4 | Carrier C (0) | 16.4 | 36 | 1103 | D | A | 1.49 | D | D | D |
| Example 4 | Carrier D (20) | 16.1 | 36 | 474 | A | A | 1.67 | A | A | A |
| Comparative Example 5 | Carrier D (0) | 16.2 | 38 | 1138 | D | A | 1.47 | D | D | D |
| Example 5 | Carrier E (20) | 11.5 | 26 | 187 | A | B | 1.75 | B | A | B |
| Comparative Example 6 | Carrier E (0) | 12.3 | 28 | 811 | D | A | 1.62 | D | D | D |
| Comparative Example 7 | Carrier E (30) | 10.4 | 25 | 122 | A | C | 1.82 | C | C | C |

(3) Image Density

The image density of the center portion of a 30 mm×30 mm solid part of the printed image was measured at 5 sites under the above-mentioned developing conditions using X-Rite 938, a spectrophotometric colorimetry densitometer to obtain an average value.

(4) Granularity

For the respective developers, the granularity defined by the following Equation (brightness range: 50 to 80) was measured, and based on the calculated value, the respective developers were evaluated as to the granularity in accordance with the following criteria.

$$\text{Granularity}=\exp(aL+b)\int(WS(f))^{1/2}\cdot VTF(f)df$$

wherein "L" represents an average brightness, "f" represents a space frequency (cycle/mm), WS (f) represents a power spectrum of brightness variations, VTF (f) represents a visual property of space frequency, and "a" and "b" each represents a coefficient.

[Evaluation Criteria]

A (excellent): zero or more to less than 0.1

B (good): 0.1 or more to less than 0.2

C (allowable to use): 0.2 or more to less than 0.3

D (unallowable to use): 0.3 or more

As is clear from the results shown in Table 4, Examples 1 to 5 were superior to Comparative Examples 1 to 7, in (1) Counter-Charge Type Carrier Adhesion, (2) Induced Charge Type Carrier Adhesion, (3) Image Density, (4) Granularity, (5) Background Smear and (6) Carrier Adhesion After Running Output of 20,000 Sheets. In particular, the developers of Examples 2 to 5 had short relaxation times, less counter-charge type carrier adhesions and high image densities. The developers of Examples 2 to 4, in which the relaxation times were 200 sec. to 700 sec., could achieve the reduction of the induced charge type carrier adhesion, and have better results than those of Examples 1 and 5 in granularity and carrier adhesion after funning output of 20,000 sheets.

<Evaluation 2>

The image quality was evaluated in the same manner as in Evaluation 1, except that the developing bias was changed to the following conditions. The toner prepared in Preparation Example of Toner and respective carriers A to E prepared in Preparation Examples of Carriers were used to produce respective developers, and by using the developer images were formed to confirm the image quality. The results are shown in Table 5. The image was formed by Imagio Color 5000 (a digital color photocopier/printer complex unit, manufactured by Ricoh Company Ltd.) under the following development conditions.

—Development Conditions—

Developing gap (the distance between a photoconductor and developing sleeve): 0.3 mm Doctor gap (the distance between a developing sleeve and doctor blade): 0.7 mm Linear speed of the photoconductor: 245 mm/sec The ratio of the linear speed of the developing sleeve to the linear speed of the photoconductor: 1.5

Writing density: 600 dpi

Charge potential (Vd): −750V

Electric potential of an image portion (solid image) after exposure: −100V

Developing bias: DC component −500V/alternate current bias component: 2 kHz, −100V to −900V, 50% duty

TABLE 5

| | Carrier | Resistance LogR (Ωcm) | Toner charge amount (μc/g) | Relaxation time (sec) | Carrier adhesion (counter charge type) | Carrier adhesion (black solid part) | Image density | Granularity | Initial background smear | Carrier adhesion after running output of 20,000 sheets |
|---|---|---|---|---|---|---|---|---|---|---|
| Example 1 | Carrier A (20) | 16.3 | 37 | 705 | C | B | 1.61 | B | A | B |
| Comparative Example 1 | Carrier A (0) | 16.3 | 38 | 1,195 | D | B | 1.57 | D | D | D |
| Comparative Example 2 | Carrier A (15) | 16.3 | 37 | 828 | D | B | 1.65 | D | D | D |
| Example 2 | Carrier B (20) | 16.1 | 35 | 601 | B | B | 1.67 | A | A | B |
| Comparative Example 3 | Carrier B (0) | 16.2 | 36 | 1,127 | D | B | 1.56 | D | D | D |
| Comparative Example 3 | Carrier C (20) | 16.3 | 34 | 554 | B | B | 1.69 | A | A | A |
| Comparative Example 4 | Carrier C (0) | 16.4 | 36 | 1,103 | D | B | 1.55 | D | D | D |
| Example 4 | Carrier D (20) | 16.1 | 36 | 474 | A | B | 1.72 | A | A | A |
| Comparative Example 5 | Carrier D (0) | 16.2 | 38 | 1,138 | D | B | 1.52 | D | D | D |
| Example 5 | Carrier E (20) | 11.5 | 26 | 187 | A | C | 1.81 | A | A | C |
| Comparative Example 6 | Carrier E (0) | 12.3 | 28 | 811 | D | B | 1.69 | D | D | D |
| Comparative Example 7 | Carrier E (30) | 10.4 | 25 | 122 | B | D | 1.88 | D | D | D |

What is claimed is:

1. A carrier, comprising:

core material particles having magnetism; and a coating layer on the surfaces of the core material particles, wherein the core material particles have a magnetization at a magnetic field of 1,000 Oersted of 40 emu/g to 100emu/g, and the carrier has a weight average particle diameter of 20 μm to 45 μm, a resistance (Log R) of 11 Ω·cm to 17 Ω·cm and a relaxation time τ of 150 seconds to 800 seconds, wherein the core material particle is composed of Cu—Zn ferrite, and the coating layer comprises at least silicon resin and alumina particles.

2. The carrier according to claim 1, wherein the carrier has a weight average particle diameter Dw of 22 μm to 32 μm, and a ratio (Dw/Dp) of the weight average particle diameter Dw to a number average particle diameter of the carrier Dp satisfies 1<(Dw/Dp)<1.20, the amount of the particles having a particle diameter of less than 20 μm is 0% by weight to 7% by weight, the amount of the particles having a particle diameter of less than 36 μm is 80% by weight to 100% by weight, and the amount of the particles having a particle diameter of less than 44 μm is 90% by weight to 100% by weight.

3. The carrier according to claim 1, wherein the bulk density of the core material particles is 2.15 g/cm$^3$ to 2.70 g/cm$^3$.

4. A developer, comprising:

a toner; and the carrier of claim 1.

5. The developer according to claim 4, wherein the toner has a charge amount of 15 μc/g to 30 μc/g when the toner coverage on the carrier is 50%.

6. An electrophotographic developing method comprising:

supplying a toner from a developer containing the carrier of claim 1 and the toner to a surface of a photoconductor on which a latent electrostatic image is formed; and developing the latent electrostatic image using the toner so as to form a visible image, wherein a direct current voltage as a developing bias is applied when the toner is supplied from the developer to the photoconductor.

7. The electrophotographic developing method according to claim 6, wherein the carrier has a weight average particle diameter Dw of 22 μm to 32 μm, and a ratio (Dw/Dp) of the weight average particle diameter Dw to a number average particle diameter of the carrier Dp satisfies 1<(Dw/Dp)<1.20, the amount of the particles having a particle diameter of less than 20 μm is 0% by weight to 7% by weight, the amount of the particles having a particle diameter of less than 36 μm is 80% by weight to 100% by weight, and the amount of the particles having a particle diameter of less than 44 μm is 90% by weight to 100% by weight.

8. The electrophotographic developing method according to claim 6, wherein the bulk density of the core material particles is 2.15 g/cm$^3$ to 2.70 g/cm$^3$.

9. The electrophotographic developing method according to claim 6, wherein the toner which is supplied to the photoconductor is coated on the surface of the carrier, and the toner has a charge amount of 15 μc/g to 30 μc/g when the toner coverage on the carrier is 50%.

10. An image forming method comprising:

charging a surface of a photoconductor;

exposing the charged surface of the photoconductor so as to form a latent electrostatic image;

supplying a toner from a developer containing the carrier of claim 1 and the toner to the surface of the photoconductor on which the latent electrostatic image is formed;

developing the latent electrostatic image using the toner so as to form a visible image;

transferring the visible image to a recording medium; and fixing the transferred image on the recording medium, wherein a direct current voltage as a developing bias is applied when the toner is supplied from the developer to the photoconductor.

* * * * *